US010810945B2

(12) United States Patent
Li et al.

(10) Patent No.: US 10,810,945 B2
(45) Date of Patent: Oct. 20, 2020

(54) DISPLAY PANEL AND DISPLAY DEVICE

(71) Applicant: WUHAN TIANMA MICRO-ELECTRONICS CO., LTD., Wuhan (CN)

(72) Inventors: Bo Li, Wuhan (CN); Zhaokeng Cao, Shanghai (CN); Tianqing Hu, Shanghai (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/225,563

(22) Filed: Dec. 19, 2018

(65) Prior Publication Data

US 2020/0105201 A1 Apr. 2, 2020

(30) Foreign Application Priority Data

Sep. 30, 2018 (CN) ..... 2018 1 1157351

(51) Int. Cl.
*G09G 3/3266* (2016.01)
*G09G 3/3275* (2016.01)
*G09G 3/36* (2006.01)

(52) U.S. Cl.
CPC ..... *G09G 3/3266* (2013.01); *G09G 3/3275* (2013.01); *G09G 3/3674* (2013.01); *G09G 3/3685* (2013.01); *G09G 2310/0278* (2013.01)

(58) Field of Classification Search
None
See application file for complete search history.

(56) References Cited

U.S. PATENT DOCUMENTS

2017/0249896 A1* 8/2017 Kim ..... G09G 3/3225
2017/0337877 A1* 11/2017 Kim ..... G09G 3/3225
2018/0005585 A1* 1/2018 Kim ..... G09G 3/3233
2018/0040291 A1* 2/2018 Wu ..... G09G 5/003
2018/0090061 A1* 3/2018 Kim ..... H01L 27/3223
2018/0151660 A1* 5/2018 Kim ..... H01L 27/3276
2018/0315387 A1* 11/2018 Park ..... G09G 3/3674
2019/0080648 A1* 3/2019 Hwang ..... G09G 3/3233

FOREIGN PATENT DOCUMENTS

CN 105633117 A 6/2016
CN 107134473 A 9/2017
CN 107340660 A 11/2017

* cited by examiner

*Primary Examiner* — David D Davis
(74) *Attorney, Agent, or Firm* — Anova Law Group PLLC

(57) ABSTRACT

A display panel and a display device are provided. The display panel includes a display region; a non-display region; and at least one notch. The display region includes a first edge, a plurality of data lines, a plurality of scanning lines, and a plurality of light-emitting control lines. The plurality of data lines and the first edge extend along a column direction. The first edge is recessed toward the display region to form the at least one notch. The plurality of light-emitting control lines includes first light-emitting control lines and second light-emitting control lines. The non-display region includes a plurality of first light-emitting controllers in a cascade configuration disposed at one side of the first light-emitting control lines away from the at least one notch. An output terminal of each of the plurality of first light-emitting controllers is electrically connected to at least one of the first light-emitting control lines.

16 Claims, 16 Drawing Sheets

DISPLAY PANEL AND DISPLAY DEVICE

CROSS-REFERENCES TO RELATED APPLICATION

This application claims the priority of Chinese Patent Application No. 201811157351.8, filed on Sep. 30, 2018, the content of which is incorporated herein by reference in its entirety.

TECHNICAL FIELD

The present disclosure generally relates to the field of display technology and, more particularly, relates to a display panel and a display device.

BACKGROUND

Current display devices such as monitors, televisions, cell phones, and tablets, often have a regular rectangular shape. However, demands on the screens of the display devices become more and more diverse. A display panel may have a shape other than a rectangle, such as a convex polygon, a concave polygon, a circle, and a ring. This kind of display panel is denoted as an irregularly shaped display panel. The irregularly shaped display panel may be designed to have a shape to avoid function modules in the display panel. The function modules may be camera modules, sensor modules and speaker modules. A screen ratio of the display panel and thus a display effect may be improved.

How to design an irregularly shaped display panel with a good performance to continuously improve users' experience is a key problem to be solved. The disclosed display panel and the display device are directed to solve one or more problems set forth above and other problems in the art.

SUMMARY

One aspect of the present disclosure provides a display panel. The display panel comprises: a display region; a non-display region surrounding the display region; and at least one notch. The display region includes a first edge, a plurality of data lines, a plurality of scanning lines, and a plurality of light-emitting control lines. The plurality of data lines and the first edge extend along a column direction. The first edge is recessed toward an inside of the display region to form the at least one notch. The display region includes a first display region and a second display region. The plurality of light-emitting control lines includes a plurality of first light-emitting control lines in the first display region and a plurality of second light-emitting control lines in the second display region. The non-display region includes a plurality of first light-emitting controllers in a cascade configuration disposed at one side of the plurality of first light-emitting control lines away from the at least one notch. An output terminal of each of the plurality of first light-emitting controllers is electrically connected to at least one of the plurality of first light-emitting control lines.

Another aspect of the present disclosure provides a display device. The display device includes a display panel. The display panel comprises: a display region; a non-display region surrounding the display region; and at least one notch. The display region includes a first edge, a plurality of data lines, a plurality of scanning lines, and a plurality of light-emitting control lines. The plurality of data lines and the first edge extend along a column direction. The first edge is recessed toward an inside of the display region to form the at least one notch. The display region includes a first display region and a second display region. The plurality of light-emitting control lines includes a plurality of first light-emitting control lines in the first display region and a plurality of second light-emitting control lines in the second display region. The non-display region includes a plurality of first light-emitting controllers in a cascade configuration disposed at one side of the plurality of first light-emitting control lines away from the at least one notch. An output terminal of each of the plurality of first light-emitting controllers is electrically connected to at least one of the plurality of first light-emitting control lines.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
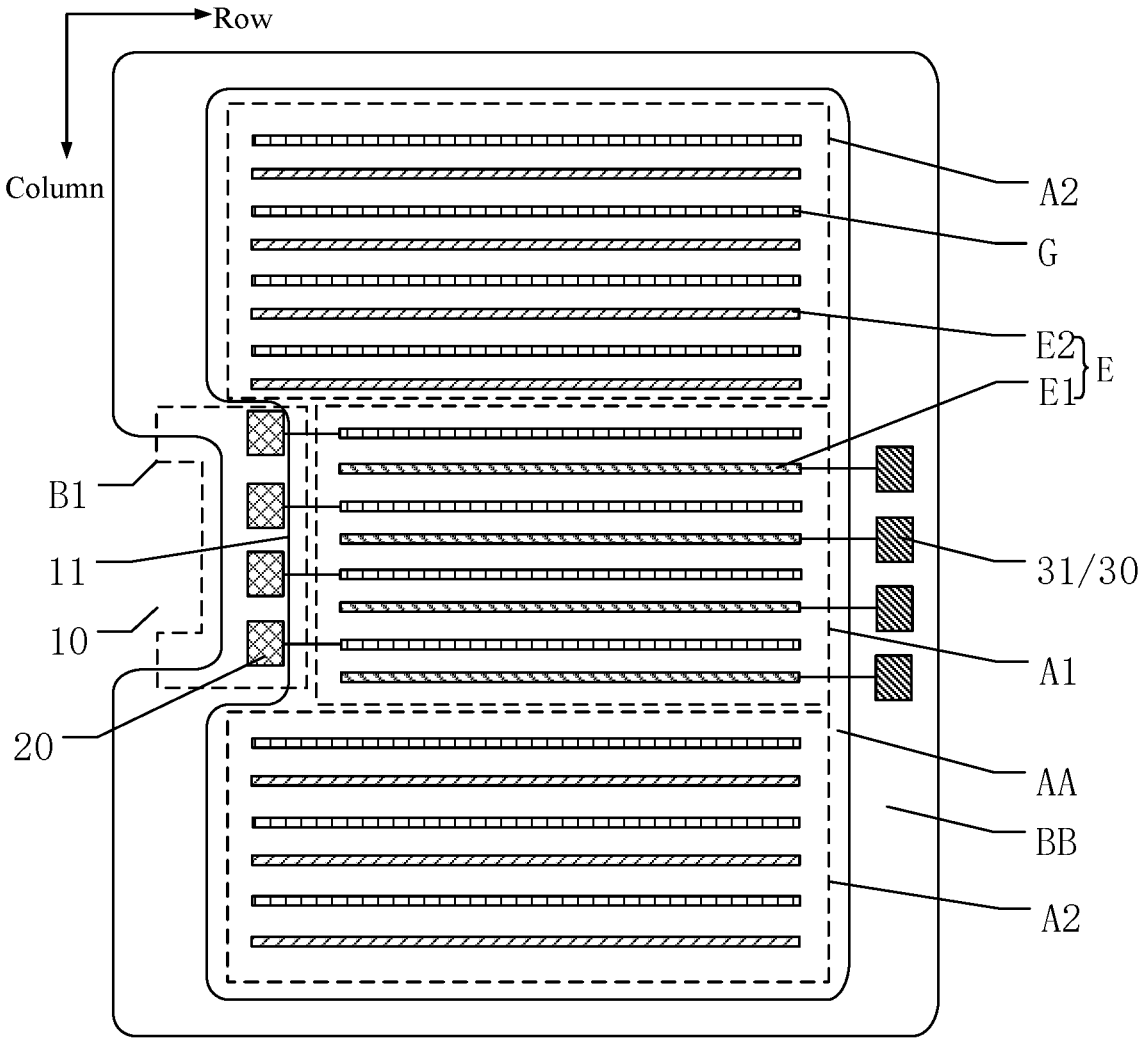
FIG. 1 illustrates a planar structure of an exemplary display panel consistent with various disclosed embodiments in the present disclosure.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Moreover, the present disclosure is described with reference to schematic diagrams. For the convenience of descriptions of the embodiments, the cross-sectional views illustrating the device structures may not follow the common proportion and may be partially exaggerated. Besides, those schematic diagrams are merely examples, and not intended to limit the scope of the invention. Furthermore, a three-dimensional (3D) size including length, width and depth should be considered during practical fabrication.

As display technologies develop, irregularly shaped display panels are used more and more widely. In an irregularly shaped display panel, an irregularly shaped region is disposed to accommodate some important devices such as cameras and earpieces more easily, and to provide users with a diverse experience.

Because of the irregularly shaped region, a line arrangement a border close to the irregularly shaped region becomes denser. To reduce an influence on the display performance, a width of the border of the display panel close to the irregularly shaped region may be increased. But a screen ratio of the display panel cannot be increased. Another method is removing a portion of driving devices to provide spaces for line arrangement. But a difference between a display brightness in the irregularly shaped region and in other regions of the display panel may appear more or less. This difference becomes more obvious when the irregularly shaped region becomes larger. Forming a display panel with a large size becomes difficult.

The present disclosure provides a display panel to solve one or more problems set forth above and other problems in the art. FIG. 1 illustrates an exemplary display panel consistent with various disclosed embodiments in the present disclosure. The display panel may include a display region AA, a non-display region BB surrounding the display region AA, and at least one notch 10. The display region AA may include a first edge 11, a plurality of data lines D, a plurality of scanning lines G, and a plurality of light-emitting control lines E. The plurality of scan lines G and the plurality of light-emitting control lines E may extend along a row direction. The first edge 11 and the plurality of data lines D may extend along a column direction. The first edge 11 may be recessed toward an inside of the display region AA, to form the notch 10.

The non-display region BB may include a first non-display region B1. The first non-display region B1 may be adjacent to the notch 10. The display region AA may include a first display region A1 and a second display region A2. The first display region A1 and the second display region A2 may be disposed along the column direction. The first display region A1 may be adjacent to the first non-display region B1.

The plurality of light-emitting control lines E may include a plurality of first light-emitting control lines E1 and a plurality of second light-emitting control lines E2. The plurality of first light-emitting control lines E1 may be disposed in the first display region A1, and the plurality of second light-emitting control lines E2 may be disposed in the second display region A2.

The non-display region BB may include a plurality of scanning drivers 20 and a plurality of light-emitting controllers 30. An output terminal of each of the plurality of scanning drivers 20 may be electrically connected to at least one of the plurality of scanning lines G.

The plurality of light-emitting controllers 30 may include a plurality of first light-emitting controllers 31 in a cascade configuration. The plurality of first light-emitting controllers 31 may be disposed at one side of the plurality of first light-emitting control lines E1 away from the notch 10. An output terminal of each of the plurality of first light-emitting controllers 31 may be electrically connected to at least one of the plurality of first light-emitting control lines E1.

In one embodiment, the first edge 11 and the plurality of data lines D may extend along the column direction. The first edge 11 may be recessed toward an inside of the display region AA, to form the notch 10. The notch 10 may provide a space for devices such as cameras, to meet requirements of users' visual effects.

Output terminals of the plurality of scanning drivers 20 may be electrically connected to the plurality of scanning lines G, and scanning signals may be transmitted to the plurality of scanning lines G through the plurality of scanning drivers 20. Output terminals of the plurality of first light-emitting controllers 31 may be electrically connected to the plurality of first light-emitting control lines E1. Light-emitting control signals may be transmitted to the plurality of first light-emitting control lines E1 through the plurality of first light-emitting controllers 31.

To illustrate various embodiments of the present disclosure, other structures in the display panel are not shown in FIG. 1, and different pattern fillings are used to distinguish the plurality of scanning lines G, the plurality of first light-emitting control lines E1, and the plurality of second light-emitting control lines E2. For description purposes only, the present disclosure is described in FIG. 1 by using a display panel with one first display region A1 and one second display region A2 as an example, and has no limit on a number of the first display region A1 and a number of the second display region A2. In various embodiments, the display panel may include one or more first display regions A1, and one or more second display regions A2.

Figure 2:
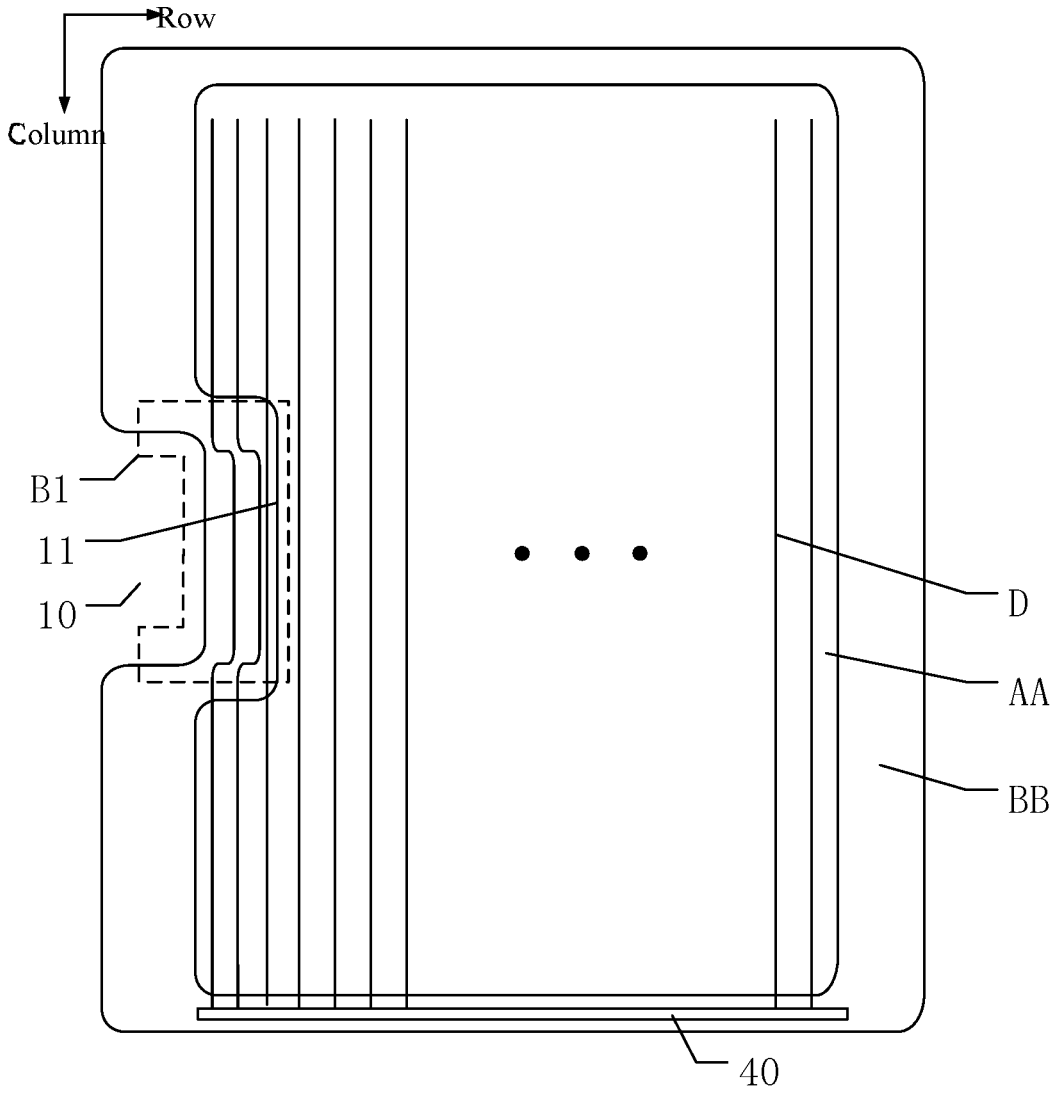
FIG. 2 illustrates a planar structure of another exemplary display panel consistent with various disclosed embodiments in the present disclosure.

As illustrated in FIG. 2, because the first edge 11 may be recessed toward the inside of the display region AA to form the notch 10, a portion of the plurality of data lines D which should pass the first display region A1 may pass the first non-display region B1, to provide data signals to the display panel normally. Then a line arrangement in the first non-display region B1 may be denser than in other regions of the non-display region BB. Since the plurality of first light-emitting controller 31 may be disposed at one side of the plurality of first light-emitting control lines E1 away from the notch 10, the plurality of first light-emitting controller 31 may be located away from the first non-display region B1, an influence on the arrangement of the plurality of data lines D by the plurality of first light-emitting controller 31 may be reduced. A display performance of the display panel may be improved.

In one embodiment, the plurality of data lines D may provide data signals through a driving chip 40 in the non-display region BB of the display panel directly. In other embodiments, the plurality of data lines D may provide data signals by disposing one or more data driving devices. The present disclosure has no limit on ways for the plurality of data lines D to provide data signals.

To directly illustrate various embodiments of the present disclosure, FIG. 2 only illustrates an arrangement of the plurality of data lines D and the driving chip 40. Other structures in FIG. 2 may be same as the display panel illustrated in FIG. 1.

Figure 3:
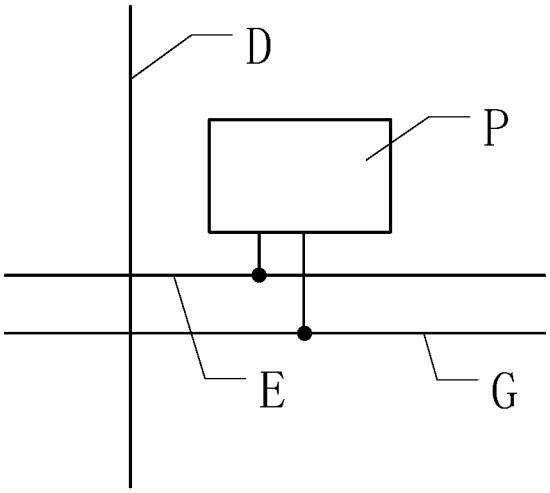
FIG. 3 illustrates a pixel driving structure of an exemplary display panel consistent with various disclosed embodiments in the present disclosure.

The display panel usually may display images through some pixels P cooperatively. As illustrated in FIG. 3, when the scanning driving device 20 provides scanning signals to one of the plurality of scanning lines G, a portion of pixels P connected to the one of the plurality of scanning lines G may be selected, and the portion of pixels P which is selected may receive data signals from the plurality of data lines D. Consequently, the portion of pixels P which is selected may illuminate, and an illuminating time may be controlled by a corresponding portion of light-emitting control lines E.

In one embodiment, an output terminal of the plurality of the first light-emitting controllers 31 may be electrically connected to one of the plurality of first light-emitting control lines E1, and the plurality of first light-emitting control lines E1 may be disposed in the first display region A1. Correspondingly, the plurality of the first light-emitting controllers 31 may be used to control an illuminating time of display pixels P in the first display region A1.

Figure 4:
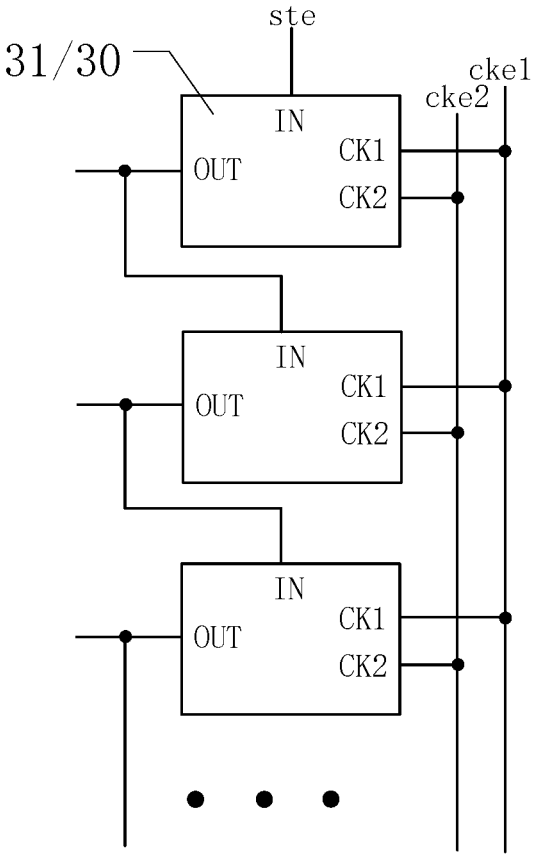
FIG. 4 illustrates a cascade circuit for a light emitting controller for an exemplary display panel consistent with various disclosed embodiments in the present disclosure.

The plurality of first light-emitting controller 31 may be in a cascade configuration. As illustrated in FIG. 4, input terminals CK1 and CK2 of each level first light-emitting controller of the plurality of first light-emitting controllers 31 may receive clock signals cke1 and ck32. An input terminal IN of a first level first light-emitting controller of the plurality of first light-emitting controllers 31 may receive initial signals ste. Starting with a second level first light-emitting controller of the plurality of first light-emitting controllers 31, an input terminal IN of each level first light-emitting controller of the plurality of first light-emitting controllers 31 may be electrically connected to an output terminal OUT of a previous level first light-emitting controller of the plurality of first light-emitting controllers 31. Light-emitting control signals may be transmitted to each level first light-emitting controller of the plurality of first light-emitting controllers 31 gradually, to control an illuminating time of pixels P. For description purposes only, the present disclosure is illustrated by using a display panel in FIG. 4 where the plurality of first light-emitting controller 31 is in a cascade configuration as an example only. The present disclosure has no limit on a connection configuration of the plurality of first light-emitting controller 31. The plurality of first light-emitting controller 31 may be in any suitable configuration in various embodiments of the present disclosure.

In various embodiments of the present disclosure, the plurality of scanning drivers 20 may be driven by some different driving methods. In one embodiment, as illustrated in FIG. 1, the plurality of scanning drivers 20 may be driven by a single-side driving method. The plurality of scanning drivers 20 may be disposed at a same side of the display region AA, and an output terminal of each of the plurality of scanning drivers 20 may be electrically connected to one of the plurality of scan lines G. For description purposes only, the present disclosure is described by using a display panel in FIG. 1 where the plurality of scanning drivers 20 is driven by a single-side driving method as an example only, and has no limit on the driving method of the plurality of scanning drivers 20. In various embodiments of the present disclosure, the plurality of scanning drivers 20 may be driven by any suitable driving methods. For example, the output terminal of each of the plurality of scanning drivers 20 may be electrically connected to two or more of the plurality of scan lines G, and the plurality of scanning drivers 20 may be driven by other driving methods besides the single-side driving method.

In the display panel provided by various embodiments of the present disclosure, the first edge extending along a direction same as an extending direction of the plurality of data lines may be recessed to form the notch. A region where the notch is disposed may accommodate devices such as cameras. A diverse requirement of users' visual effect may be satisfied. The notch may be disposed adjacent to the first non-display region and the plurality of first light-emitting controllers may be disposed at one side of the plurality of first light-emitting control lines away from the notch. Correspondingly, the plurality of first light-emitting controllers may not occupy a space of the first non-display region. A width of the first non-display region along the row direction may be reduced. A screen ratio of the display panel may be improved and a display device with a narrow border may be formed. Further, the plurality of first light-emitting controllers and the plurality of scanning drivers may provide signals to the plurality of first light-emitting control lines and the plurality of scan lines in the first display region normally. A reduce in a number of signal devices may be avoided and a display performance of the display device may be improved.

Figure 5:
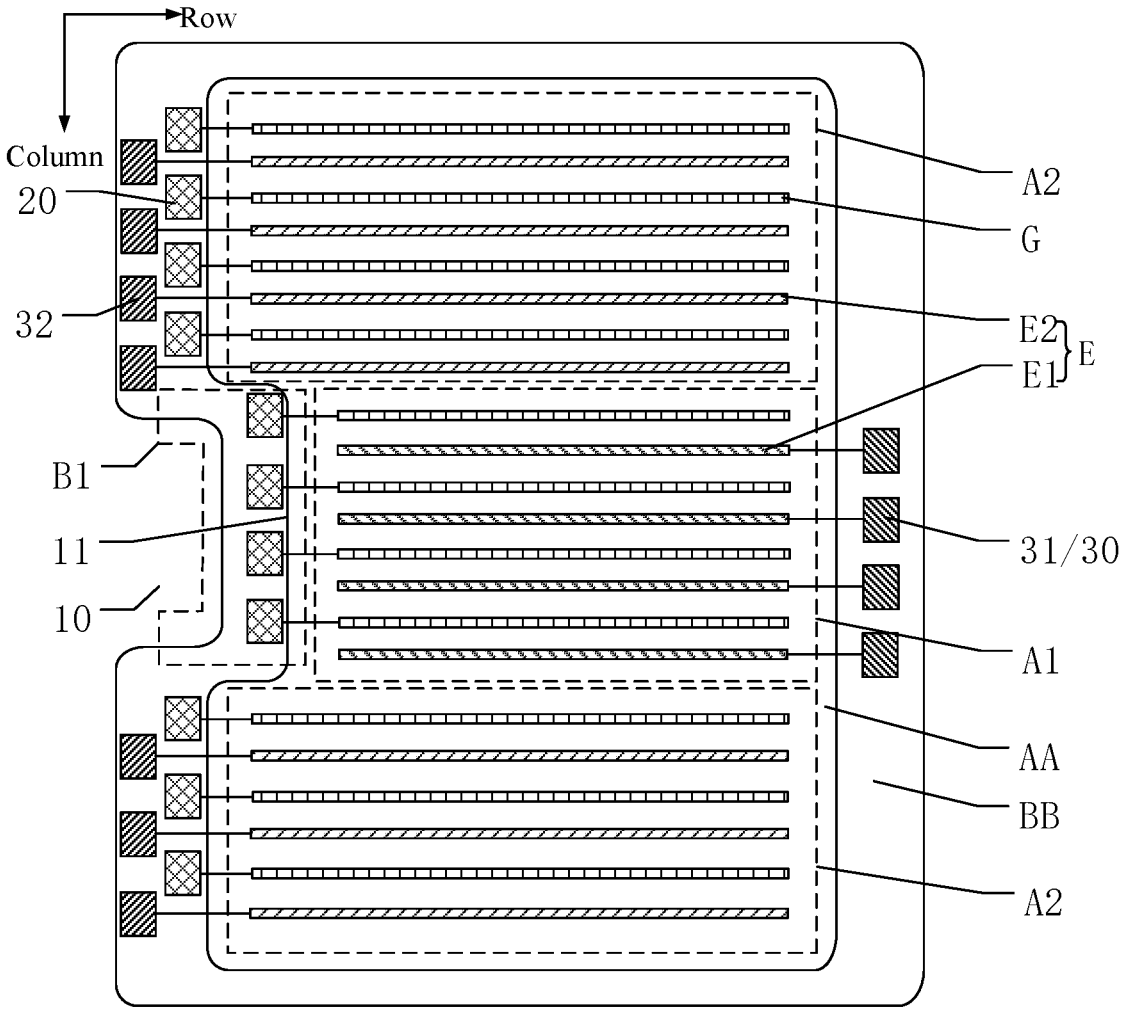
FIG. 5 illustrates a planar structure of another exemplary display panel consistent with various disclosed embodiments in the present disclosure.

In some embodiments, as illustrated in FIG. 2, FIG. 3, and FIG. 5, the plurality of light-emitting controllers 30 may further include a plurality of second light-emitting controllers 32. An output terminal of each of the plurality of second light-emitting controllers 32 may be electrically connected to at least one of the plurality of second light-emitting control lines E2.

Since an output terminal of each of the plurality of second light-emitting controllers 32 may be electrically connected to at least one of the plurality of second light-emitting control lines E2 and the plurality of second light-emitting control lines E2 may be disposed in the second display region A2, the plurality of second light-emitting control lines E2 may be used to control an illuminating time of the pixels P in the second display region A2. To keep a load consistency for each of the plurality of second light-emitting control lines E2 and avoid an influence on an arrangement of the plurality of data lines D in the first non-display region B1, the plurality of second light-emitting controllers 32 may be disposed in the non-display region BB except the first non-display region B1.

Figure 6:
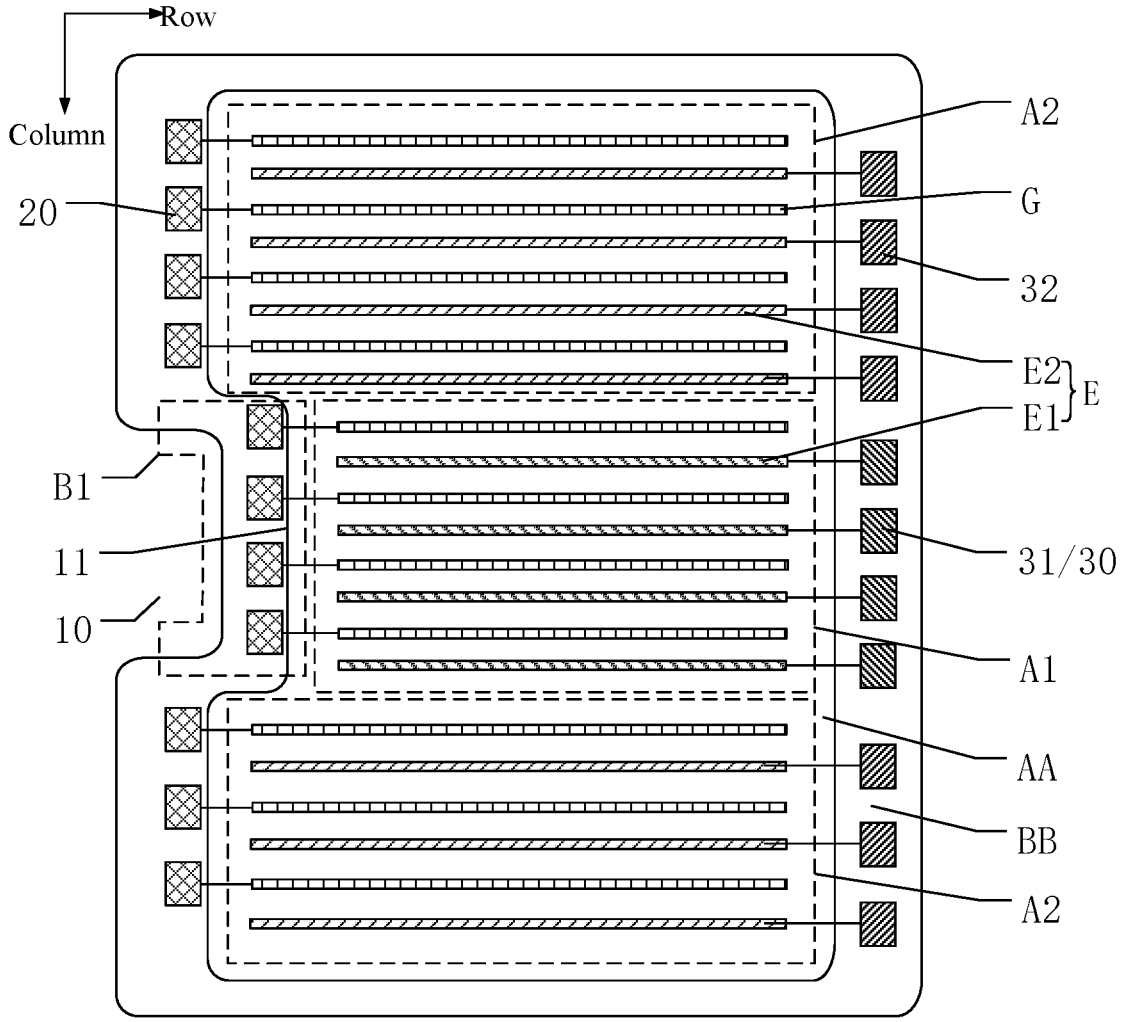
FIG. 6 illustrates a planar structure of another exemplary display panel consistent with various disclosed embodiments in the present disclosure.

The plurality of second light-emitting controllers 32 may be connected in various ways, and the present disclosure has no limit on this. For example, the plurality of second light-emitting controllers 32 may be connected in a cascade configuration similar to the cascade configuration of the plurality of first light-emitting controllers 31, or in some other ways. The plurality of second light-emitting controllers 32 may be disposed at different positions in the non-display region BB, and the present disclosure has no limit on this. For example, in one embodiment as illustrated in FIG. 5, all of the plurality of second light-emitting controllers 32 may be disposed at one side of plurality of second light-emitting control lines E2 close to the notch 10. In another embodiment, as illustrated in FIG. 6, all of the plurality of second light-emitting controllers 32 may be disposed at one side of plurality of second light-emitting control lines E2 close to the plurality of first light-emitting controllers 31. In various embodiments, the plurality of second light-emitting controllers 32 may be disposed at other positions.

Figure 7:
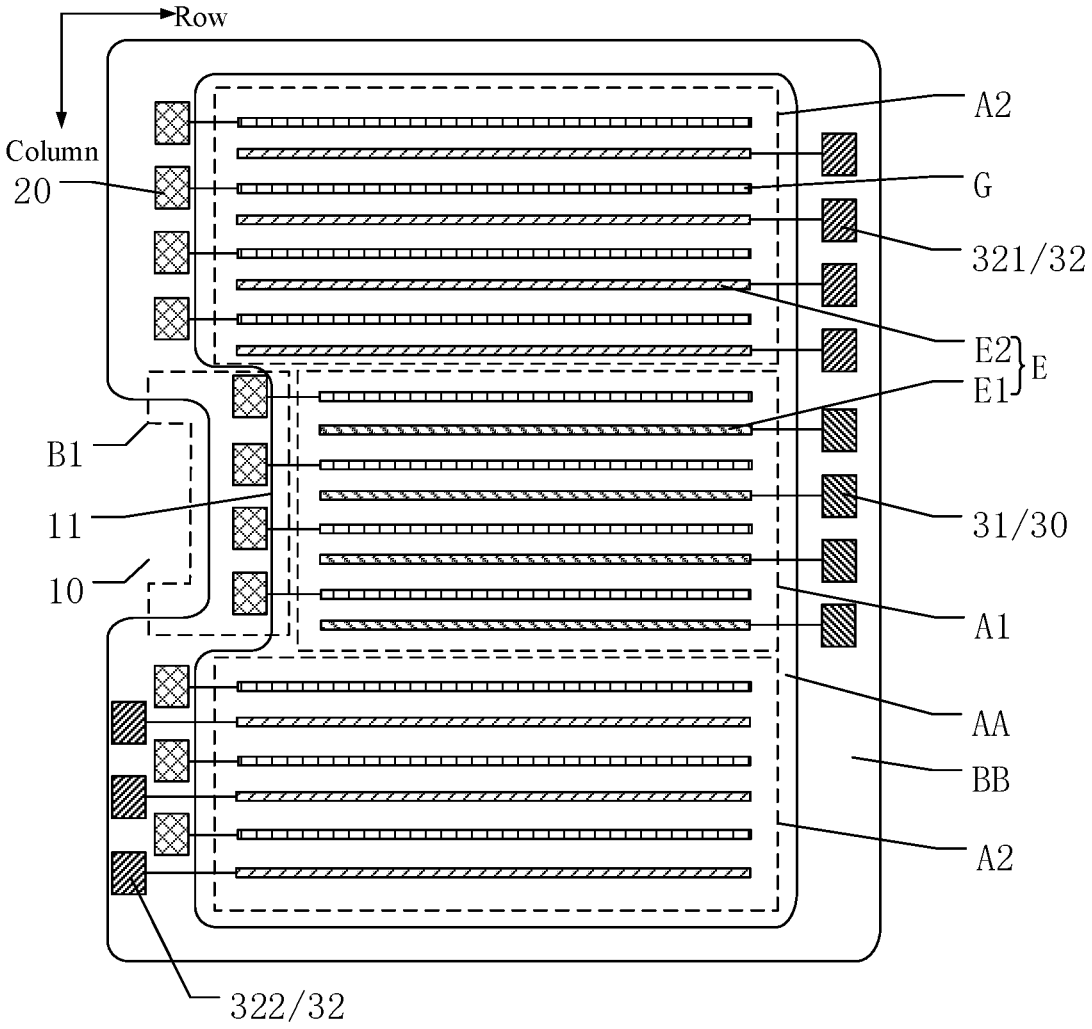
FIG. 7 illustrates a planar structure of another exemplary display panel consistent with various disclosed embodiments in the present disclosure.

In one embodiment, as illustrated in FIG. 7, the plurality of second light-emitting controllers 32 may include a plurality of first sub light-emitting controllers 321 in a cascade configuration and a plurality of second sub light-emitting controllers 322 in a cascade configuration. The plurality of first sub light-emitting controllers 321 may be disposed at one side of plurality of second light-emitting control lines E2 close to the plurality of first light-emitting controllers 31, and the plurality of second sub light-emitting controllers 322 may be disposed at another side of plurality of second light-emitting control lines E2 away from the plurality of first light-emitting controllers 31.

Specifically, the plurality of first sub light-emitting controllers 321 may be disposed at one side of plurality of second light-emitting control lines E2 close to the plurality of first light-emitting controllers 31, and the plurality of second sub light-emitting controllers 322 may be disposed at another side of plurality of second light-emitting control lines E2 away from the plurality of first light-emitting controllers 31. Correspondingly, the plurality of first sub light-emitting controllers and the plurality of second sub light-emitting controllers 322 may be disposed at different sides of plurality of second light-emitting control lines E2 respectively. Positions and a number of the plurality of second light-emitting controllers 32 may be adjusted according to a line arrangement of the display panel.

In some embodiments, the plurality of first sub light-emitting controllers 321 and the plurality of second sub light-emitting controllers 322 may use same internal circuit structures or different internal circuit structures, and the present disclosure has no limit on this. The plurality of first sub light-emitting controllers 321 may be connected in a cascade configuration similar to the cascade configuration of the plurality of first light-emitting controllers 31 illustrated in FIG. 4, and the plurality of second sub light-emitting controllers 322 may be connected in a cascade configuration similar to the cascade configuration of the plurality of first light-emitting controllers 31 illustrated in FIG. 4. The plurality of first sub light-emitting controllers 321 and the plurality of second sub light-emitting controllers 322 may be connected in any other suitable configurations. The present disclosure has no limit on this.

A number of the plurality of first sub light-emitting controllers 321 and a number of the plurality of second sub light-emitting controllers 322 may be configured according to actual conditions, as long as each of the plurality of second light-emitting control lines E2 in the second display region A2 is electrically connected to one of the plurality of second light-emitting controllers 32 so the one of the plurality of second light-emitting controllers 32 provides light-emitting control signals to corresponding one of the plurality of second light-emitting control lines E2. The present disclosure has no limit on the number of the plurality of first sub light-emitting controllers 321 and the number of the plurality of second sub light-emitting controllers 322.

Figure 8:
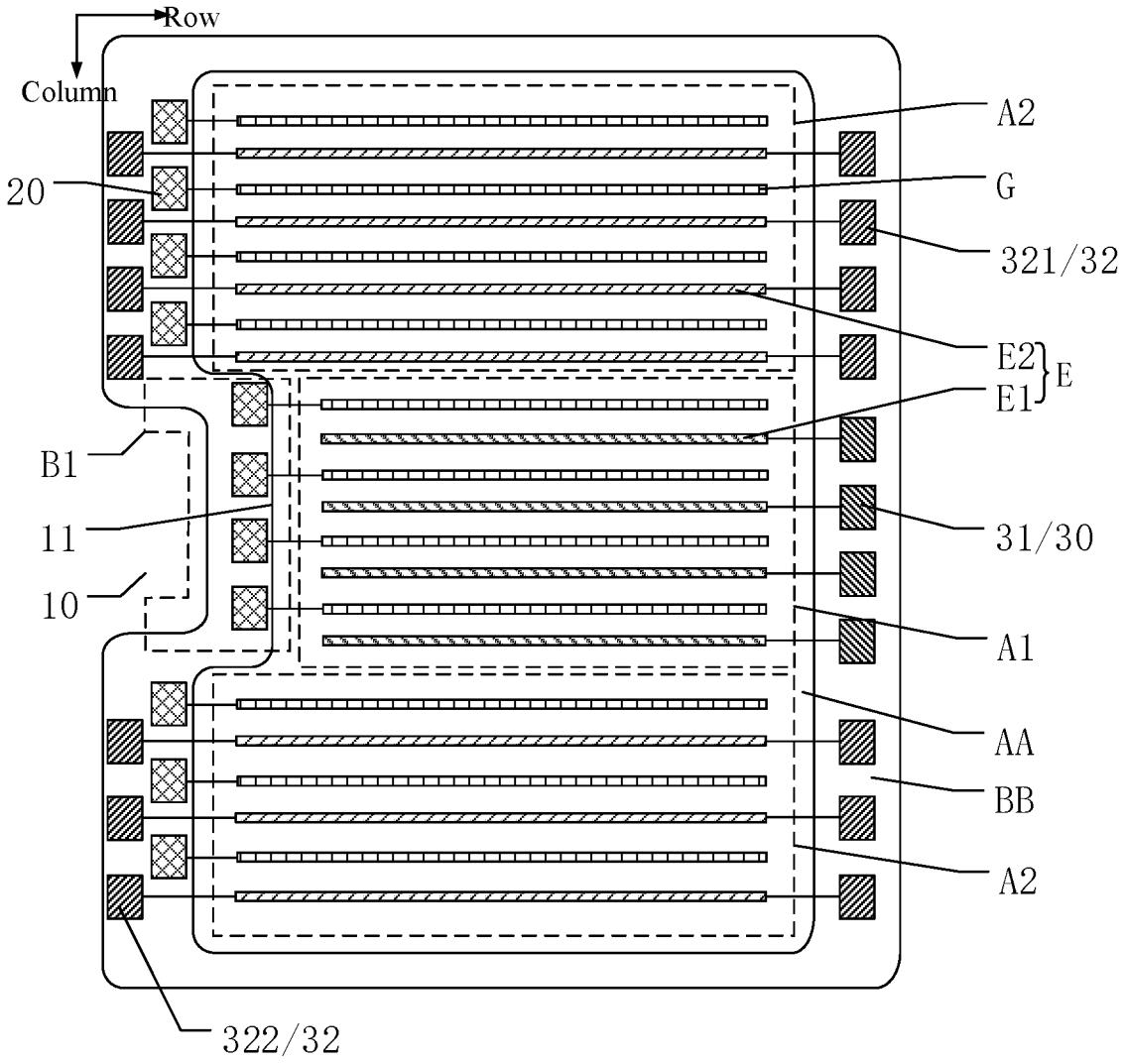
FIG. 8 illustrates a planar structure of another exemplary display panel consistent with various disclosed embodiments in the present disclosure.

In one embodiment, as illustrated in FIG. 8, two ends of each of the plurality of second light-emitting control lines E2 may be electrically connected to an output terminal of one of the plurality of first sub light-emitting controllers 321 and to an output terminal of one of the plurality of second sub light-emitting controllers 322 respectively. One of the plurality of first sub light-emitting controllers 321 and one of the plurality of second sub light-emitting controllers 322 may provide light-emitting control signals to two ends of one of the plurality of second light-emitting control lines E2 respectively. When clock signals provided to the plurality of first sub light-emitting controllers 321 and the plurality of second sub light-emitting controllers 322 are synchronized, the plurality of first sub light-emitting controllers 321 and the plurality of second sub light-emitting controllers 322 may realize a bilateral driving to the plurality of second light-emitting control lines E2. A display uniformity of the display panel may be improved.

Alternatively, when the display panel displays images, only a portion of the plurality of first sub light-emitting controllers 321 and/or a portion of the plurality of second sub light-emitting controllers 322 may provide the light-emitting control signals. Another portion of the plurality of first sub light-emitting controllers 321 and another portion of the plurality of second sub light-emitting controllers 322 may provide the light-emitting control signals cannot provide the light-emitting control signals, and may be used as virtual light-emitting controllers to ensure a display performance of the display panel.

Figure 9:
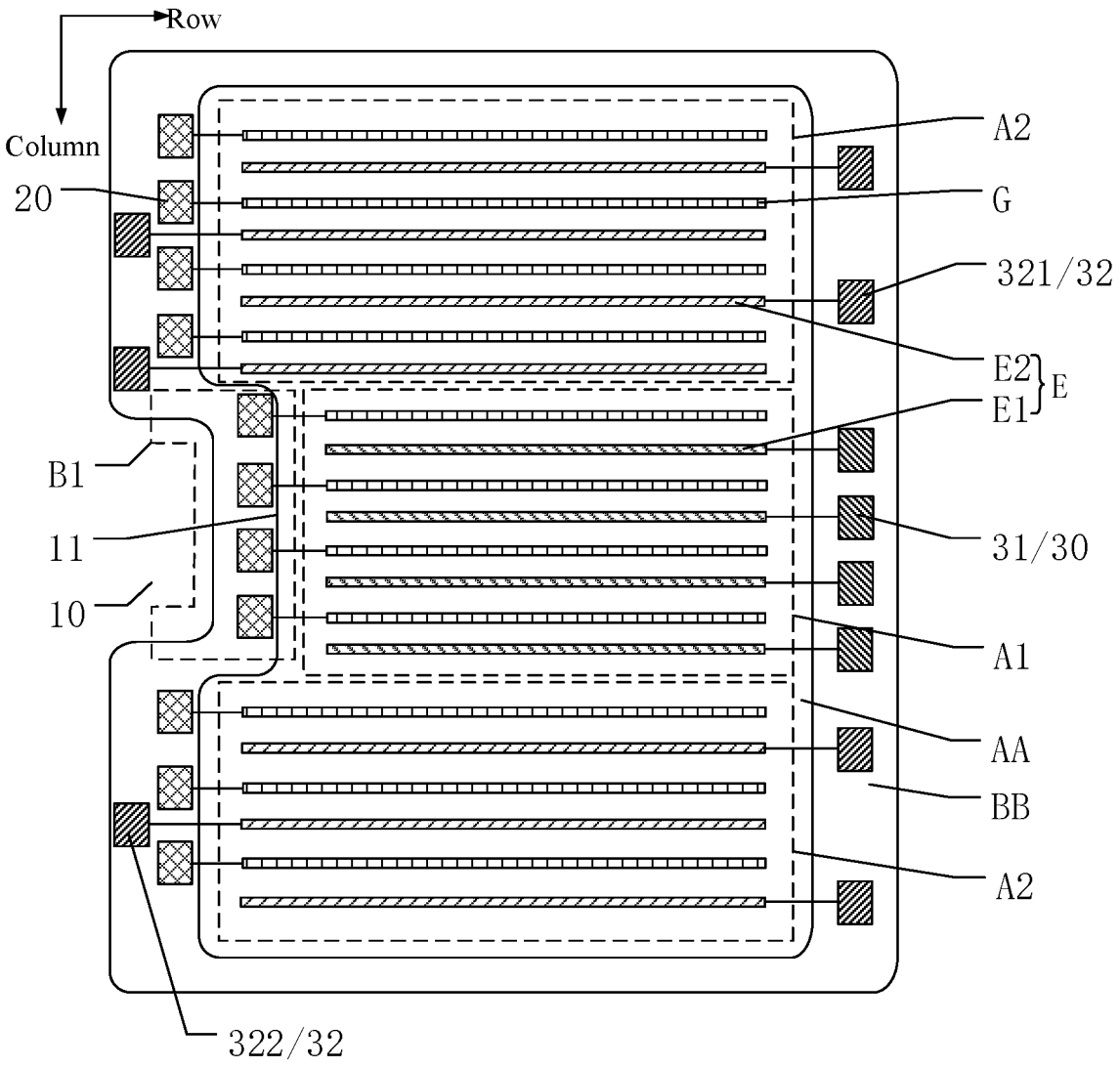
FIG. 9 illustrates a planar structure of another exemplary display panel consistent with various disclosed embodiments in the present disclosure.
Figure 10:
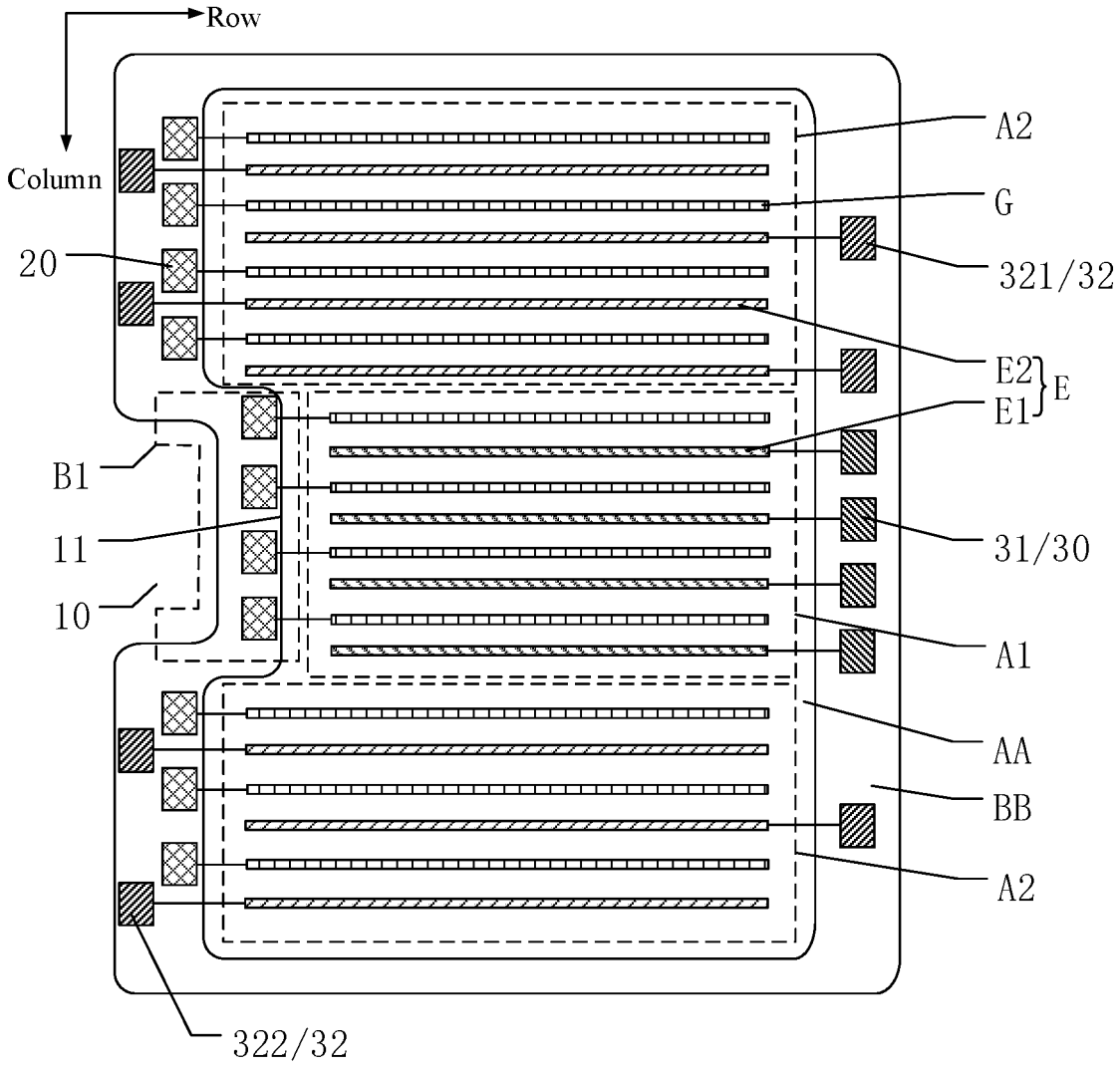
FIG. 10 illustrates a planar structure of another exemplary display panel consistent with various disclosed embodiments in the present disclosure.

In various embodiments, as illustrated in FIGS. 9-10, the output terminal of each of the plurality of first sub light-emitting controllers 321 may be electrically connected to one odd-row second light-emitting control line of the plurality of second light-emitting control lines E2, and the output terminal of each of the plurality of second sub light-emitting controllers 322 may be electrically connected to one even-row second light-emitting control line of the plurality of second light-emitting control lines E2; or the output terminal of each of the plurality of first sub light-emitting controllers 321 may be electrically connected to one even-row second light-emitting control line of the plurality of second light-emitting control lines E2, and the output terminal of each of the plurality of second sub light-emitting controllers 322 may be electrically connected to one odd-row second light-emitting control line of the plurality of second light-emitting control lines E2.

In one embodiment illustrated in FIG. 9, the output terminal of each of the plurality of first sub light-emitting controllers 321 may be electrically connected to one odd-row second light-emitting control line of the plurality of second light-emitting control lines E2, and the output terminal of each of the plurality of second sub light-emitting controllers 322 may be electrically connected to one even-row second light-emitting control line of the plurality of second light-emitting control lines E2. Correspondingly, the plurality of second light-emitting control lines E2 may be bilateral driven through the plurality of first sub light-emitting controllers 321 and the plurality of second sub light-emitting controllers 322. The display uniformity of the display panel may be improved.

In another embodiment illustrated in FIG. 10, the output terminal of each of the plurality of first sub light-emitting controllers 321 may be electrically connected to one even-row second light-emitting control line of the plurality of second light-emitting control lines E2, and the output terminal of each of the plurality of second sub light-emitting controllers 322 may be electrically connected to one odd-row second light-emitting control line of the plurality of second light-emitting control lines E2. Correspondingly, the plurality of second light-emitting control lines E2 may be bilateral driven through the plurality of first sub light-emitting controllers 321 and the plurality of second sub light-emitting controllers 322.

The plurality of first sub light-emitting controllers 321 may be connected in a cascade configuration similar to the cascade configuration of the plurality of first light-emitting controllers 31 illustrated in FIG. 4, and the plurality of second sub light-emitting controllers 322 may be connected in a cascade configuration similar to the cascade configuration of the plurality of first light-emitting controllers 31 illustrated in FIG. 4. When the plurality of second light-emitting controllers 32 is disposed at two sides of the notch 10 along the column direction, a portion of lines may be wound into the first non-display region B1 similar to the plurality of data lines D illustrated in FIG. 2. The portion of lines wound into the first non-display region B1 may occupy a very small space of the first non-display region B1, and may barely have any influence on the display performance of the display panel. Alternatively, the plurality of first sub light-emitting controllers 321 and the plurality of second sub light-emitting controllers 322 may be connected in any other suitable configurations and the present disclosure has no limit on this.

Figure 11:
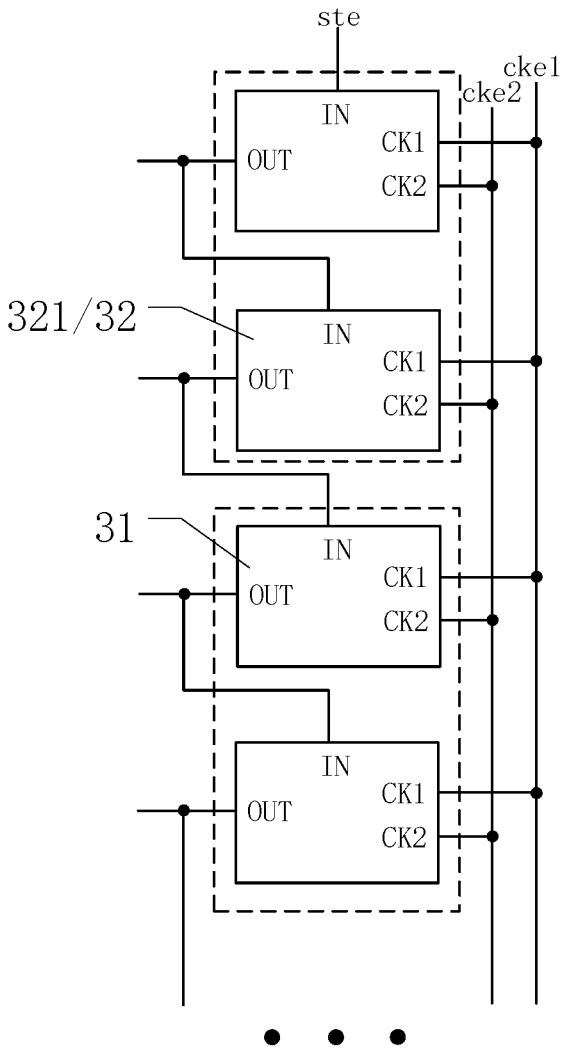
FIG. 11 illustrates a cascade circuit for another light emitting controller for an exemplary display panel consistent with various disclosed embodiments in the present disclosure.

In one embodiment, as illustrated in FIGS. 10-11, the plurality of first sub light-emitting controllers 321 may be connected to the plurality of first light-emitting controllers 31 in a cascade configuration. Correspondingly, a first-level light-emitting controller may be one of the plurality of first sub light-emitting controllers 321 or one of the plurality of first light-emitting controllers 31, determined by a configuration of the first display region A1 and the second display region A2.

Since the plurality of first sub light-emitting controllers 321 may be connected to the plurality of first light-emitting controllers 31 in a cascade configuration, and the plurality of first sub light-emitting controllers 321 and the plurality of first light-emitting controllers 31 may share clock signals cke1 and cke2, only one starting signal ste may be needed to provide light-emitting control signals to the plurality of first light-emitting control lines E1 and the plurality of second light-emitting control lines E2. A difficult and a space for a line arrangement in the display panel may be reduced, and a manufacturing efficiency of the display panel may be improved.

Figure 12:
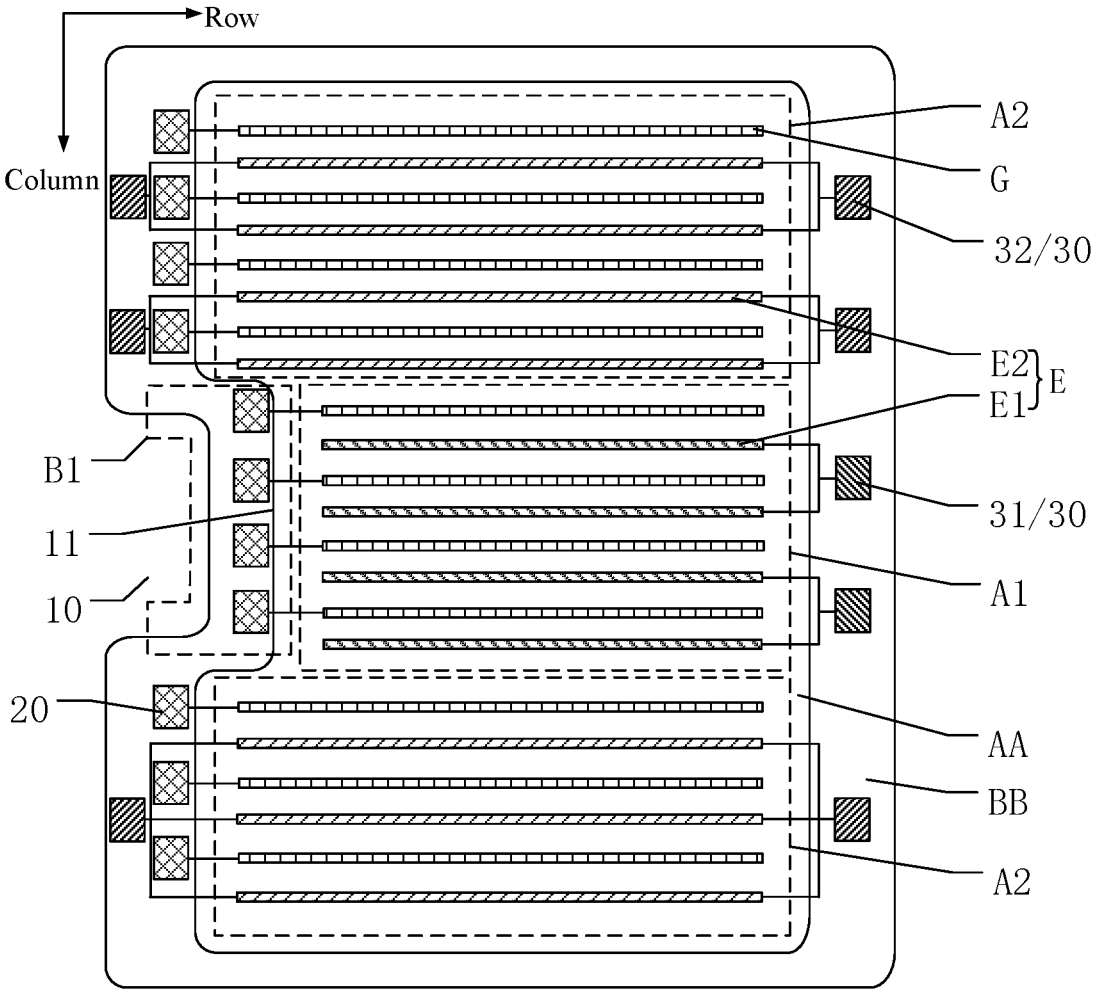
FIG. 12 illustrates a planar structure of another exemplary display panel consistent with various disclosed embodiments in the present disclosure.

In some other embodiments, as illustrated in FIG. 12, the output terminal of each of the plurality of first light-emitting controllers 31 may be electrically connected to at least two of the plurality of first light-emitting control lines E1, and the output terminal of each of the plurality of second light-emitting controllers 32 may be electrically connected to at least two of the plurality of second light-emitting control lines E2.

In the display panel provided by various embodiments of the present disclosure, the output terminal of each of the plurality of first light-emitting controllers 31 may be electrically connected to two or more of the plurality of first light-emitting control lines E1, and the output terminal of each of the plurality of second light-emitting controllers 32 may be electrically connected to two or more of the plurality of second light-emitting control lines E2. A number of first light-emitting control lines E1 of the plurality of first light-emitting control lines E1 electrically connected to each of the plurality of first light-emitting controllers 31 may be same. A number of second light-emitting control lines of the plurality of second light-emitting control lines E2 electrically connected to each of the plurality of second light-emitting controllers 32 may be same. A number of the plurality of light-emitting controllers 30, and a space in the non-display region BB which the plurality of light-emitting controllers 30 occupies, may be reduced. Lines in the non-display region BB may be arranged flexibly. A width of the non-display region BB along the row direction may be reduced, and the display panel with a narrow border may be formed.

Figure 13:
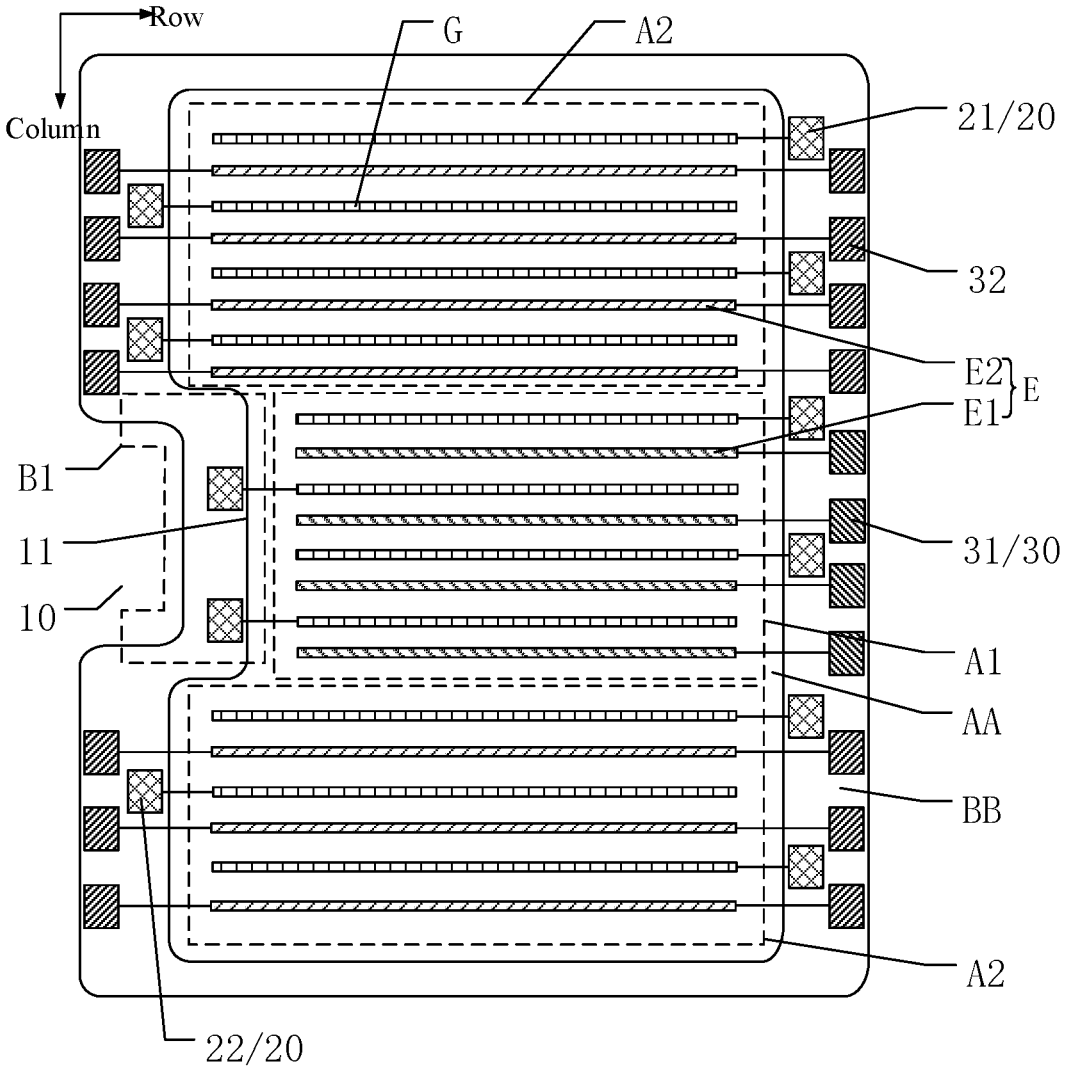
FIG. 13 illustrates a planar structure of another exemplary display panel consistent with various disclosed embodiments in the present disclosure.

In some embodiments, as illustrated in FIG. 13, the plurality of scanning drivers 20 may include a plurality of first scanning drivers 21 in a cascade configuration and a plurality of second scanning drivers 22 in a cascade configuration. The plurality of first scanning drivers 21 may be disposed at one side of the plurality of scan lines G close to the plurality of first light-emitting controllers 31, and the plurality of second scanning drivers 22 may be disposed at another side of the plurality of scan lines G away from the plurality of first light-emitting controllers 31.

In the present disclosure, the plurality of first scanning drivers 21 may be disposed at one side of the plurality of scan lines G close to the plurality of first light-emitting controllers 31, and the plurality of second scanning drivers 22 may be disposed at another side of the plurality of scan lines G away from the plurality of first light-emitting controllers 31. The plurality of first scanning drivers 21 and the plurality of second scanning drivers 22 may be disposed at different sides of the plurality of scan lines G. Positions and numbers of the plurality of scanning drivers 20 in the non-display region BB may be configured flexibly according to a line arrangement of the display panel.

The plurality of first scanning drivers 21 and the plurality of second scanning drivers 22 may have same internal circuit structures, or different internal circuit structures. The present disclosure has no limit on this.

Figure 14:
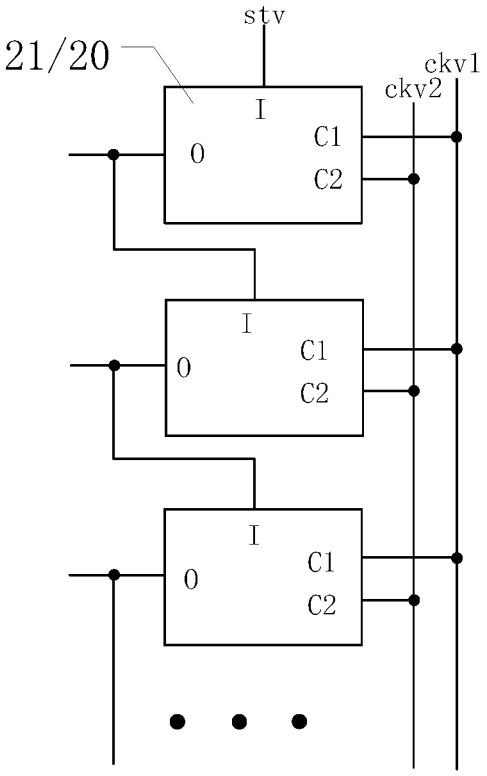
FIG. 14 illustrates a cascade circuit of a scanning driving device for another exemplary display panel consistent with various disclosed embodiments in the present disclosure.

The plurality of first scanning drivers 21 may be connected in a cascade configuration, and the plurality of second scanning drivers 22 may be connected in a cascade configuration, as illustrated in FIG. 14. For the plurality of first scanning drivers 21 in a cascade configuration, input terminals C1 and C2 in each level first scanning driver 21 of the plurality of first scanning drivers 21 may receive clock signals ckv1 and ckv2 respectively. An input terminal I of a first level first scanning driver 21 of the plurality of first scanning drivers 21 may receive starting signals sty. Since a second level first scanning driver 21 of the plurality of first scanning drivers 21, an input terminal IN of each level first scanning driver 21 of the plurality of first scanning drivers 21 may be electrically connected to an output terminal O of a previous level first scanning driver 21 of the plurality of first scanning drivers 21, to provide scanning signals to the plurality of scanning lines G each level by each level. The display region AA may be driven to display images. The scanning signals may be forward scanning signals or reverse scanning signals according to actual requirements. The present disclosure has no limit on a type of the scanning signals.

Figure 15:
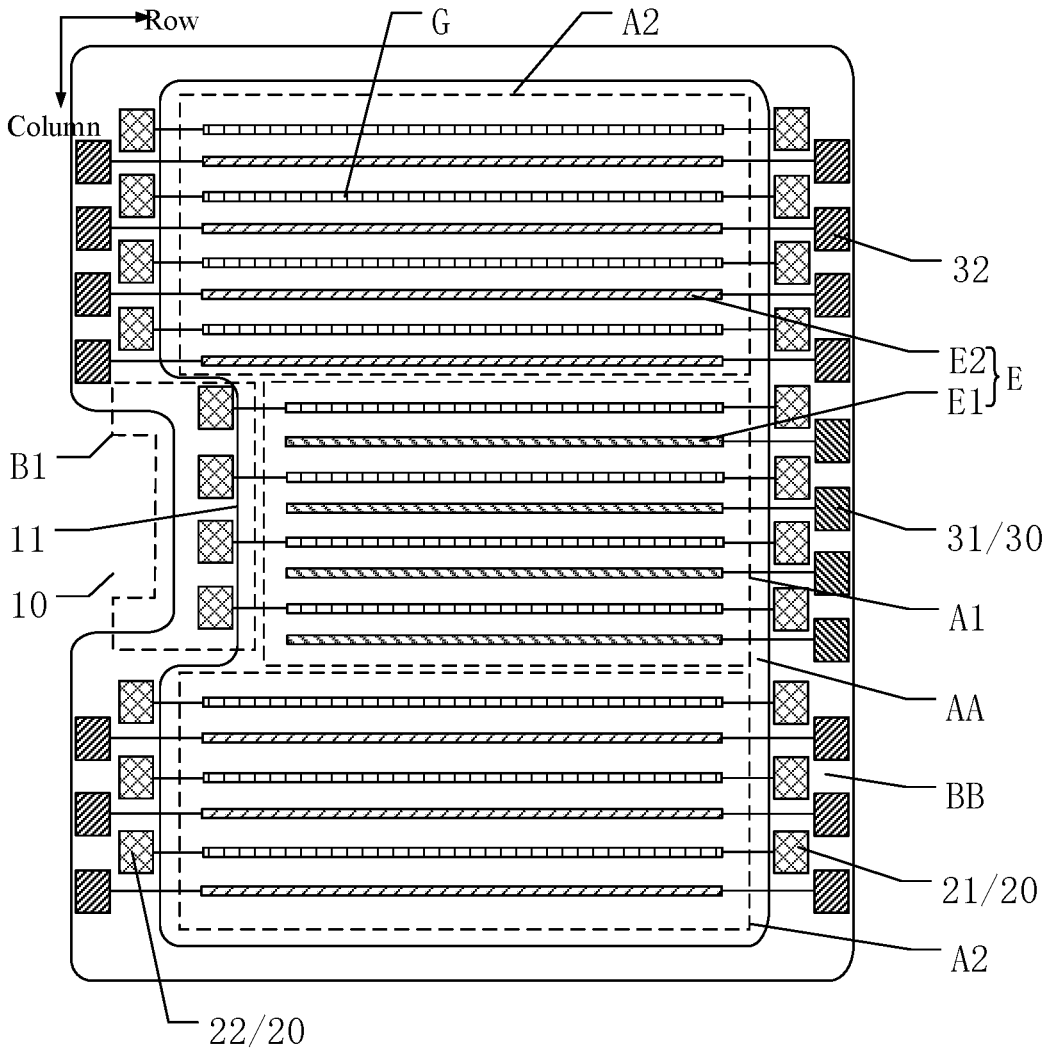
FIG. 15 illustrates a planar structure of another exemplary display panel consistent with various disclosed embodiments in the present disclosure.

In one embodiment, as illustrated in FIG. 15, two ends of each of the plurality of scanning lines G may be electrically connected to the output terminal of one of the plurality of first scanning drivers 21 and the output terminal of one of the plurality of second scanning drivers 22 respectively. The plurality of first scanning drivers 21 and the plurality of second scanning drivers 22 may provide the scanning signals to two ends of each of the plurality of scanning lines G. When the clock signals for the plurality of first scanning drivers 21 and the plurality of second scanning drivers 22 are synchronized, the plurality of first scanning drivers 21 and the plurality of second scanning drivers 22 may achieve a bilateral driving to the plurality of scanning lines G. The display uniformity of the display panel may be improved.

In some other embodiments, only a portion of the plurality of first scanning drivers 21 and a portion of the plurality of second scanning drivers 22 may provide the scanning signals. Another portion of the plurality of first scanning drivers 21 and another portion of the plurality of second scanning drivers 22 may provide the scanning signals may not provide the scanning signals, and may be used as virtual scanning drivers to improve the display performance of the display panel.

Figure 16:
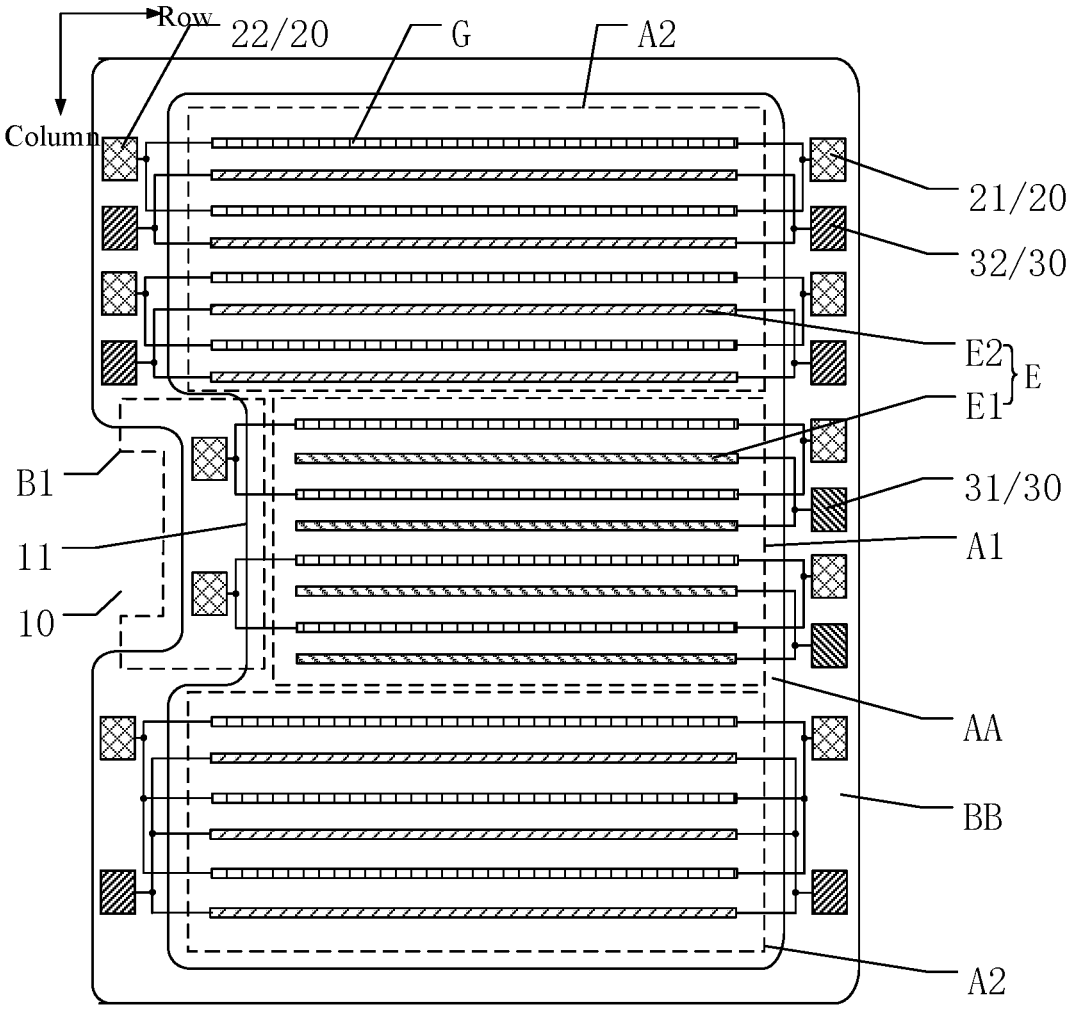
FIG. 16 illustrates a planar structure of another exemplary display panel consistent with various disclosed embodiments in the present disclosure.

In one embodiment, as illustrated in FIG. 16, the output terminal of each of the a portion of the plurality of first scanning drivers 21 may be electrically connected to at least two of the plurality of scanning lines G, and the output terminal of each of the plurality of second scanning drivers 22 may be electrically connected to at least two of the plurality of scanning lines G.

The output terminal of each of the a portion of the plurality of first scanning drivers 21 may be electrically connected to two or more of the plurality of scanning lines G, and the output terminal of each of the plurality of second scanning drivers 22 may be electrically connected to two or more of the plurality of scanning lines G. A number of the scanning lines G connected to each of the plurality of first scanning drivers 21 may be same, and a number of the scanning lines G connected to each of the plurality of second scanning drivers 22. A number of the plurality of scanning drivers 20 and then a space in the non-display region BB where the plurality of scanning drivers 20 may be reduced. Lines in the non-display region BB may be arranged more flexibly, and the width of the non-display region BB along the row direction may be reduced. A display device with a narrow border may be achieved.

As illustrated in FIG. 16, the plurality of first scanning drivers 21 and the plurality of first light-emitting controllers 31 may be disposed in same columns along the column direction. A space in the non-display region BB occupied by the plurality of first scanning drivers 21 and the plurality of first light-emitting controllers 31 may be reduced further.

In the display panel provided by various embodiments of the present disclosure, the output terminal of each of the plurality of second scanning drivers 22 may be electrically connected to at least two of the plurality of scanning lines G, and each of the plurality of second light-emitting controllers 32 may be electrically connected to at least two of the plurality of second light-emitting control lines E2. Correspondingly, the plurality of second scanning drivers 22 and the plurality of second light-emitting controllers 32 may be disposed in same columns along the column direction in the non-display region BB except the first non-display region B1. Along the row direction, a width of the non-display region BB at sides of the display region AA may be reduced and the display panel with a narrow border may be achieved.

Figure 17:
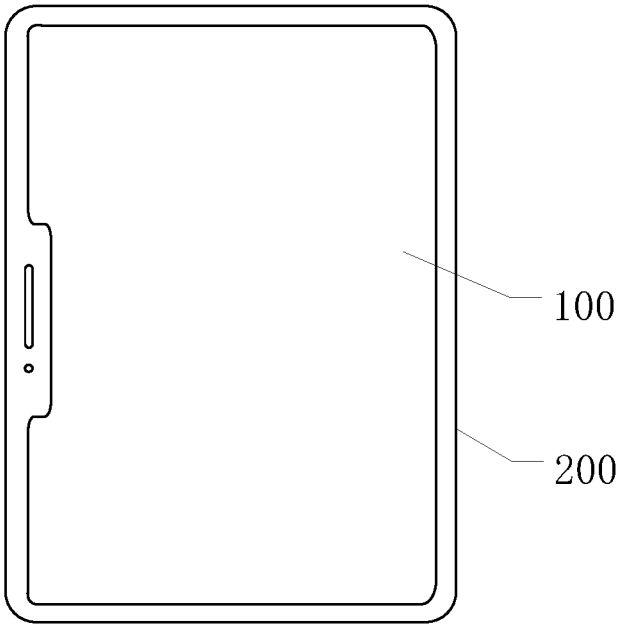
FIG. 17 illustrates an exemplary display device consistent with various disclosed embodiments in the present disclosure.

The present disclosure also provides a display device 200. The display device 200 may include a display panel 100 provided by any embodiment of the present disclosure, as illustrated in FIG. 17. For description purposes only, FIG. 17 illustrates a display device consistent with various embodiments of the present disclosure by using a cell phone as an example, and the present disclosure has no limit on a type of the display device.

In the display panel and the display device provided by various embodiments of the present disclosure, the first edge extending along the extending direction of the plurality of data lines may be recessed to form the notch. Devices such as cameras may be disposed in the notch to meet users' diverse visual requirements. The notch may be disposed adjacent to the first non-display region. Since the plurality of first light-emitting controllers may be disposed at one side of the plurality of first light-emitting control lines away from the notch. Correspondingly, the plurality of first light-emitting controllers may not occupy a space of the first non-display region. The width of the first non-display region along the row direction may be reduced and the screen ratio may be improved. Further, the plurality of first light-emitting controllers and the plurality of scanning drivers may provide signals normally to the plurality of first light-emitting control lines and to the plurality of scanning lines in the first display region. Reducing a number of signal devices may be avoided and the display performance of the display device may be improved.

Various embodiments have been described to illustrate the operation principles and exemplary implementations. It should be understood by those skilled in the art that the present invention is not limited to the specific embodiments described herein and that various other obvious changes, rearrangements, and substitutions will occur to those skilled in the art without departing from the scope of the invention. Thus, while the present invention has been described in detail with reference to the above described embodiments, the present invention is not limited to the above described embodiments, but may be embodied in other equivalent forms without departing from the scope of the present invention, which is determined by the appended claims.

What is claimed is:

1. A display panel, comprising:

a display region;

a non-display region surrounding the display region; and at least one notch, wherein:

the display region includes a first edge, a plurality of data lines, a plurality of scanning lines, and a plurality of light-emitting control lines;

the plurality of scanning lines and the plurality of light-emitting control lines extend along a row direction;

the plurality of data lines and the first edge extend along a column direction;

the first edge is recessed toward an inside of the display region to form the at least one notch;

the non-display region includes a first non-display region adjacent to the at least one notch;

the display region includes a first display region and a second display region, wherein the first display region and the second display region are arranged along the column direction, and the first display region is adjacent to the first non-display region;

the plurality of light-emitting control lines includes a plurality of first light-emitting control lines in the first display region and a plurality of second light-emitting control lines in the second display region;

the non-display region includes a plurality of scanning drivers and a plurality of light-emitting controllers;

an output terminal of each of the plurality of scanning drivers is electrically connected to at least one of the plurality of scanning lines;

the plurality of light-emitting controllers includes a plurality of first light-emitting controllers arranged in cascade;

the plurality of first light-emitting controllers is disposed at one side of the plurality of first light-emitting control lines away from the at least one notch; and an output terminal of each of the plurality of first light-emitting controllers is electrically connected to at least one of the plurality of first light-emitting control lines, wherein:

the plurality of light-emitting controllers further includes a plurality of second light-emitting controllers;

the plurality of second light-emitting controllers further include a plurality of first sub light-emitting controllers arranged in cascade;

an output terminal of each of the plurality of second light-emitting controllers is electrically connected to at least one of the plurality of second light-emitting control lines; and the plurality of first sub light-emitting controllers is connected in cascade to the plurality of first light-emitting controllers.

2. A display panel, comprising:

a display region;

a non-display region surrounding the display region; and at least one notch, wherein:

the display region includes a first edge, a plurality of data lines, a plurality of scanning lines, and a plurality of light-emitting control lines;

the plurality of scanning lines and the plurality of light-emitting control lines extend along a row direction;

the plurality of data lines and the first edge extend along a column direction;

the first edge is recessed toward an inside of the display region to form the at least one notch;

the non-display region includes a first non-display region adjacent to the at least one notch;

the display region includes a first display region and a second display region, wherein the first display region and the second display region are arranged along the column direction, and the first display region is adjacent to the first non-display region;

the plurality of light-emitting control lines includes a plurality of first light-emitting control lines in the first display region and a plurality of second light-emitting control lines in the second display region;

the non-display region includes a plurality of scanning drivers and a plurality of light-emitting controllers;

an output terminal of each of the plurality of scanning drivers is electrically connected to at least one of the plurality of scanning lines;

the plurality of light-emitting controllers includes a plurality of first light-emitting controllers arranged in cascade;

the plurality of first light-emitting controllers is disposed at one side of the plurality of first light-emitting control lines away from the at least one notch; and an output terminal of each of the plurality of first light-emitting controllers is electrically connected to at least one of the plurality of first light-emitting control lines, wherein:

the plurality of light-emitting controllers further includes a plurality of second light-emitting controllers, an output terminal of each of the plurality of second light-emitting controllers is electrically connected to at least one of the plurality of second light-emitting control lines, and wherein:

the plurality of second light-emitting controllers include a plurality of first sub light-emitting controllers arranged in cascade and a plurality of second sub light-emitting controllers arranged in cascade;

the plurality of first sub light-emitting controllers is disposed at one side of the plurality of second light-emitting control lines close to the plurality of first light-emitting controllers; and the plurality of second sub light-emitting controllers is disposed at one side of the plurality of second light-emitting control lines away from the plurality of first light-emitting controllers.

3. The display panel according to claim 2, wherein two ends of each of the plurality of second light-emitting control lines are electrically connected to an output terminal of one of the plurality of first sub light-emitting controllers and to an output terminal of one of the plurality of second sub light-emitting controllers respectively.

4. The display panel according to claim 2, wherein:

the output terminal of each of the plurality of first sub light-emitting controllers is electrically connected to one odd-row second light-emitting control line of the plurality of second light-emitting control lines; and the output terminal of each of the plurality of second sub light-emitting controllers is electrically connected to one even-row second light-emitting control line of the plurality of second light-emitting control lines.

5. The display panel according to claim 2, wherein:

the output terminal of each of the plurality of first sub light-emitting controllers is electrically connected to one even-row second light-emitting control line of the plurality of second light-emitting control lines; and the output terminal of each of the plurality of second sub light-emitting controllers is electrically connected to one odd-row second light-emitting control line of the plurality of second light-emitting control lines.

6. The display panel according to claim 1, wherein:

an output terminal of each of the plurality of first light-emitting controllers is electrically connected to at least two of the plurality of first light-emitting control lines; and the output terminal of each of the plurality of second light-emitting controllers is electrically connected to two or more of the plurality of second light-emitting control lines.

7. The display panel according to claim 6, wherein:

the plurality of scanning drivers includes a plurality of first scanning drivers arranged in cascade and a plurality of second scanning drivers arranged in cascade;

the plurality of first scanning drivers is disposed at one side of the plurality of scanning lines close to the plurality of first light-emitting controllers; and the plurality of second scanning drivers is disposed at one side of the plurality of scanning lines away from the plurality of first light-emitting controllers.

8. The display panel according to claim 7, wherein:

two ends of each of the plurality of scanning lines are electrically connected to an output terminal of one of the plurality of first scanning drivers and an output terminal of one of the plurality of second scanning drivers respectively.

9. The display panel according to claim 7, wherein:

an output terminal of each of the plurality of first scanning drivers is electrically connected to at least two of the plurality of scanning lines; and an output terminal of each of the plurality of second scanning drivers is electrically connected to at least two of the plurality of scanning lines.

10. The display panel according to claim 9, wherein the plurality of first scanning drivers and the plurality of first light-emitting controllers are disposed in a same column along the column direction.

11. A display device, comprising:

a display panel, comprising:

a display region;

a non-display region surrounding the display region; and at least one notch;

wherein:

the display region includes a first edge, a plurality of data lines, a plurality of scanning lines, and a plurality of light-emitting control lines;

the plurality of scanning lines and the plurality of light-emitting control lines extend along a row direction;

the plurality of data lines and the first edge extend along a column direction;

the first edge is recessed toward an inside of the display region to form the at least one notch;

the non-display region includes a first non-display region adjacent to the at least one notch;

the display region includes a first display region and a second display region, wherein the first display region and the second display region are arranged along the column direction, and the first display region is adjacent to the first non-display region;

the plurality of light-emitting control lines includes a plurality of first light-emitting control lines in the first display region and a plurality of second light-emitting control lines in the second display region;

the non-display region includes a plurality of scanning drivers and a plurality of light-emitting controllers;

an output terminal of each of the plurality of scanning drivers is electrically connected to at least one of the plurality of scanning lines;

the plurality of light-emitting controllers includes a plurality of first light-emitting controllers arranged in cascade;

the plurality of first light-emitting controllers is disposed at one side of the plurality of first light-emitting control lines away from the at least one notch; and an output terminal of each of the plurality of first light-emitting controllers is electrically connected to at least one of the plurality of first light-emitting control lines, wherein:

the plurality of light-emitting controllers further includes a plurality of second light-emitting controllers;

the plurality of second light-emitting controllers further include a plurality of first sub light-emitting controllers arranged in cascade;

an output terminal of each of the plurality of second light-emitting controllers is electrically connected to at least one of the plurality of second light-emitting control lines; and the plurality of first sub light-emitting controllers is connected in cascade to the plurality of first light-emitting controllers.

12. The display device according to claim 11, wherein:

the plurality of second light-emitting controllers further include a plurality of second sub light-emitting controllers arranged in cascade;

the plurality of first sub light-emitting controllers is disposed at one side of the plurality of second light-emitting control lines close to the plurality of first light-emitting controllers; and the plurality of second sub light-emitting controllers is disposed at one side of the plurality of second light-emitting control lines away from the plurality of first light-emitting controllers.

13. The display device according to claim 12, wherein two ends of each of the plurality of second light-emitting control lines are electrically connected to an output terminal of one of the plurality of first sub light-emitting controllers and to an output terminal of one of the plurality of second sub light-emitting controllers respectively.

14. The display device according to claim 12, wherein:

the output terminal of each of the plurality of first sub light-emitting controllers is electrically connected to one odd-row second light-emitting control line of the plurality of second light-emitting control lines; and the output terminal of each of the plurality of second sub light-emitting controllers is electrically connected to one even-row second light-emitting control line of the plurality of second light-emitting control lines.

15. The display device according to claim 12, wherein:

the output terminal of each of the plurality of first sub light-emitting controllers is electrically connected to one even-row second light-emitting control line of the plurality of second light-emitting control lines; and the output terminal of each of the plurality of second sub light-emitting controllers is electrically connected to one odd-row second light-emitting control line of the plurality of second light-emitting control lines.

16. The display device according to claim 11, wherein:

an output terminal of each of the plurality of first light-emitting controllers is electrically connected to at least two of the plurality of first light-emitting control lines; and the output terminal of each of the plurality of second light-emitting controllers is electrically connected to two or more of the plurality of second light-emitting control lines.

* * * * *